United States Patent [19]

Dollenmayer

[11] 4,332,489

[45] Jun. 1, 1982

[54] PRINT HAMMER ACTUATING DEVICE

[75] Inventor: William L. Dollenmayer, Versailles, Ky.

[73] Assignee: International Business Machines Corporation, Armonk, N.Y.

[21] Appl. No.: 209,364

[22] Filed: Nov. 24, 1980

[51] Int. Cl.[3] ..... B41J 1/02

[52] U.S. Cl. ..... 400/172; 400/157.2; 400/157.3; 400/166; 101/93.03; 101/93.48

[58] Field of Search ..... 400/172, 157.2, 157.3, 400/166; 101/93.48, 93.03

[56] References Cited

U.S. PATENT DOCUMENTS

| | | | |
|---|---|---|---|
| 3,731,778 | 5/1973 | Willcox | 400/172 |
| 3,892,303 | 7/1975 | Willcox | 400/172 |
| 4,189,246 | 2/1980 | Kane et al. | 400/157.3 X |

FOREIGN PATENT DOCUMENTS

| | | | |
|---|---|---|---|
| 2153979 | 5/1973 | Fed. Rep. of Germany | 101/93.48 |

OTHER PUBLICATIONS

IBM Technical Disclosure Bulletin, vol. 19, No. 9, 2-1977, pp. 3245-3246.

*Primary Examiner*—Paul T. Sewell
*Assistant Examiner*—Daniel J. Roock
*Attorney, Agent, or Firm*—John W. Girvin, Jr.

[57] ABSTRACT

An impact printer utilizes a single print hammer which is loaded with a selected type chip transferred from a rotatable carousel cartridge containing plural type chips. A single solenoid motor is energized to effect chip transfer, the loading of a spring to effect subsequent return of the chip to the cartridge, and the loading of an energy storage spring utilized to power the print hammer toward a platen. Completion of the chip transfer to the print hammer releases the print hammer to be powered by the storage spring until the solenoid motor is de-energized. The solenoid armature provides a reaction force to the storage spring only during solenoid energization. The duration of solenoid energization thus controls the impact force of the print hammer and is varied in accordance with the character area of the selected type chip and with the desired print density. An interlock latch prevents return motion of the type chip positioning and transfer mechanism during printing and during return motion of the print hammer. A restraining latch restrains the print hammer in its chip receiving position until the chip transfer to the print hammer is completed. The latching member of this latch is resiliently urged to restore the type chip to the cartridge upon return of the print hammer to its chip receiving position. An additional mechanism insures clearance of the latch member from the cartridge upon return of the type chip thereto.

16 Claims, 13 Drawing Figures

PRINT HAMMER ACTUATING DEVICE

BRIEF BACKGROUND OF THE INVENTION

1. Field

This invention relates to impact printers and more particularly to an improved print hammer actuating device for an impact printer.

2. Description of the Prior Art

Existing serial impact printers which utilize a single type element such as type ball printers and daisy wheel printers are restricted by problems of inertia and space in the size of characters they can print given a specified character set or alphabet. Such printers presently employ sophisticated electronic controls which can be economically mass-produced. While techniques are known to provide printers of alternate configurations such as typebar typewriters which are capable of printing large characters, it is particularly desirable to employ a configuration that could also make virtually direct use of existing electronic controls, thereby substantially reducing the cost of the printer.

Proposals such as those shown in U.S. Pat. No. 3,892,303 issued July 1, 1975 to Willcox, and U.S. Pat. No. 3,731,778 issued May 8, 1973 to Willcox provide a serial printer configuration where a character selection device variously known as a carousel cartridge, type chip cartridge or supply wheel carries a group of typeface chips, each bearing one character of a character set. Additional mechanism is provided to transfer a chip from the supply wheel to a light-weight impact print hammer and still further mechanism operates the hammer to impact the type against the paper or other writing media. The separation of the type element from the character selection device in these U.S. patents overcomes much of the inertial and spatial limitations which limit character size in more conventional daisy wheel or type ball printers. However, the added complexity of the separate supply wheel and hammer call for a number of operations not present in the more conventional printers and thus the devices as shown in the prior patents are not controllable directly by controls otherwise designed for the more conventional printers.

SUMMARY OF THE INVENTION

In order to overcome the above noted shortcomings of the prior art and to provide an economical serial printer capable of printing high quality oversized characters while still utilizing existing electronic controls for character selection and impact, the printer of the present invention employs a unique print hanmer actuating device. The print hammer actuating device is responsive to a single print impulse to effect energization of a solenoid motor which effects transfer of a type chip from a supply carousel cartridge to the print hammer and which further effects the loading of an energy storage mechanism to provide the energy necessary to propel the print hammer to the platen to effect printing. The time duration of the electrical impulse to the solenoid motor further controls the force of the print impact and hence the print density. Thus conventional controls presently employed in daisy wheel printers to control printing movement and print density by controlling the duration of the daisy wheel print hammer firing pulse can be readily employed in my printer to control print density. Conventional controls are also utilized to effect the positioning of the carousel cartridge to the type loading position in a manner analogous to the positioning of a daisy wheel to its print position. Positioning of the platen relative to the print mechanism to effect serial printing and line spacing are also effected by conventional controls.

Accordingly, it is a principle object of the invention to provide a serial printer capable of printing high quality oversized characters for a full 96 character set utilizing existing electronic controls for the basic functions of character selection, character spacing, and print density control.

Another object of the invention is to provide a mechanical actuator to convert a time duration control impact signal into a more complex set of actions necessary to achieve the principle object.

FIGS. *6a*, *6b* and *6c* depict motion of the type chip positioning slide.

Figure 7:
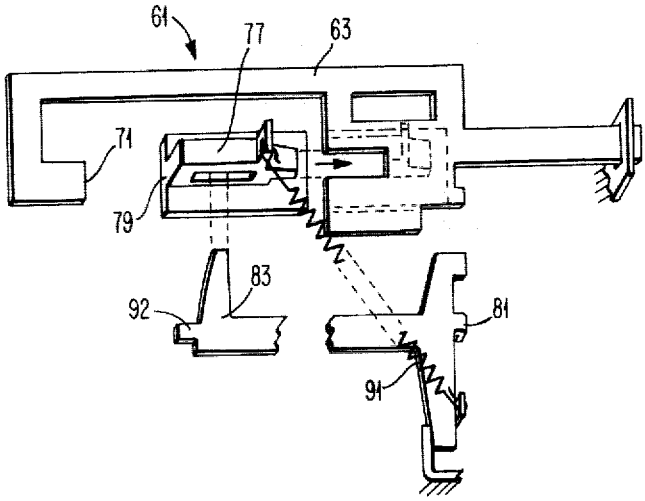

FIG. 7 is a perspective exploded view of a portion of the type chip positioning means.

Figure 8:
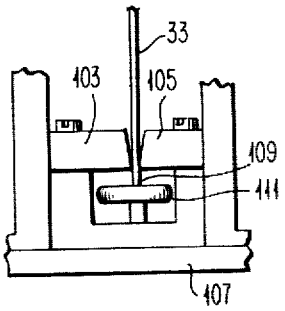

FIG. 8 is a rear view of a portion of the print hammer guide latch.

FIGS. *9a*, *9b* and *9c* are schematic motion diagrams of the print hammer and portions of the print actuator.

DESCRIPTION

Figure 1:
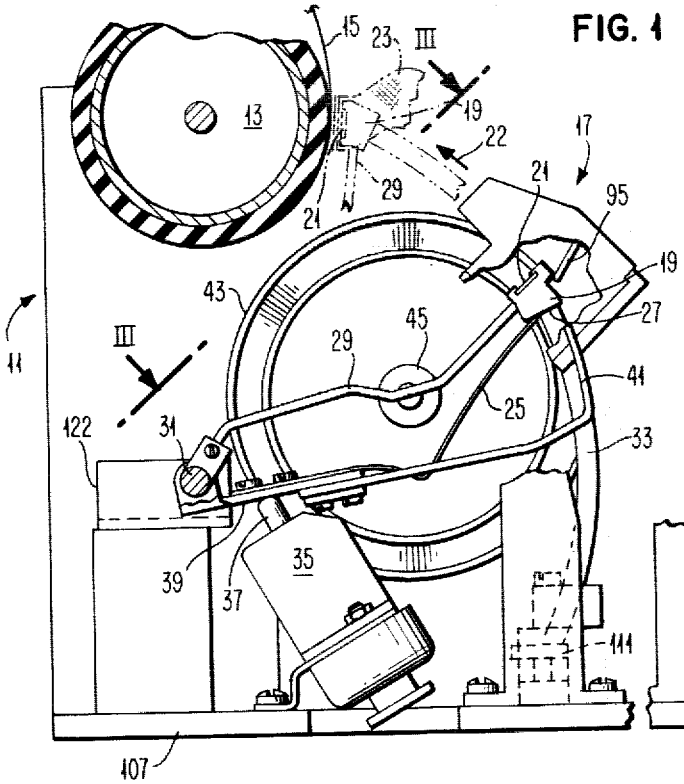
FIG. 1 is a side view of a portion of an embodiment of the invention with the print hammer in its type chip loading position.

Referring now to FIG. 1 of the drawing, a side view of a preferred embodiment of the impact printer 11 of the invention is depicted. The impact printer 11 includes a platen 13 about which is wrapped a print receiving document 15 and which is mounted for relative movement with respect to the print mechanism 17 in a conventional fashion.

The print mechanism 17 includes a print hammer 19 having a removable type chip 21 located thereon. Motion of the print hammer 19 in the direction of arrow 22 causes the type chip 21 to impact the document 15 through a print ribbon 23 to thereby create an image on the document 15. Relative motion between the platen 13 and the print mechanism 17 is thereafter effected prior to receiving a further image on the document 15 from the print hammer 19 thus creating a line of printing in a serial fashion. The print ribbon 23 is advanced as is conventionally known in the art to present a fresh ink transfer surface to the document 15 prior to subsequent impacts of the print hammer 19. Additionally, the platen 13 is rotated in a conventional manner so that successive lines of printing may be created on the document 15.

The print hammer 19 is powered toward the platen 13 by an energy storage spring 25 which pushes against the back surface 27 of the print hammer 19. The print hammer 19 includes an arm 29 which is pivoted about a shaft 31 to guide the print hammer 19 from its chip receiving position as depicted to its printing position depicted in phantom. Additionally, the hammer guide latch 33 which is fixedly secured to the back surface 27 also serves to guide the print hamemer 19 during its motion toward the platen 13 and during its return motion.

A solenoid motor 35 is energized in order to effect print hammer 19 actuation. Energerization of the solenoid motor 35 causes its armature 37 to move upward to engage an output driver 39. The output driver 39 is also rotatably mounted about the shaft 31 and pivots in a counterclockwise direction as viewed upon energization of the solenoid motor 35. As the output driver 39 thusly rotates, it causes the energy storage spring 25 attached thereto to become loaded against the back surface 27 of the print hammer 19. Further, the output driver 39 causes the slide cam arm 41 attached thereto to pivot therewith in a counterclockwise direction. As will be described, the slide cam arm 41 effects the loading of a movable type chip 21 from the carousel cartridge 43 onto the print hammer 19 and thereafter effects the release of the print hammer 19 to be powered by the energy storage spring 25 toward the platen 13.

Figure 2:
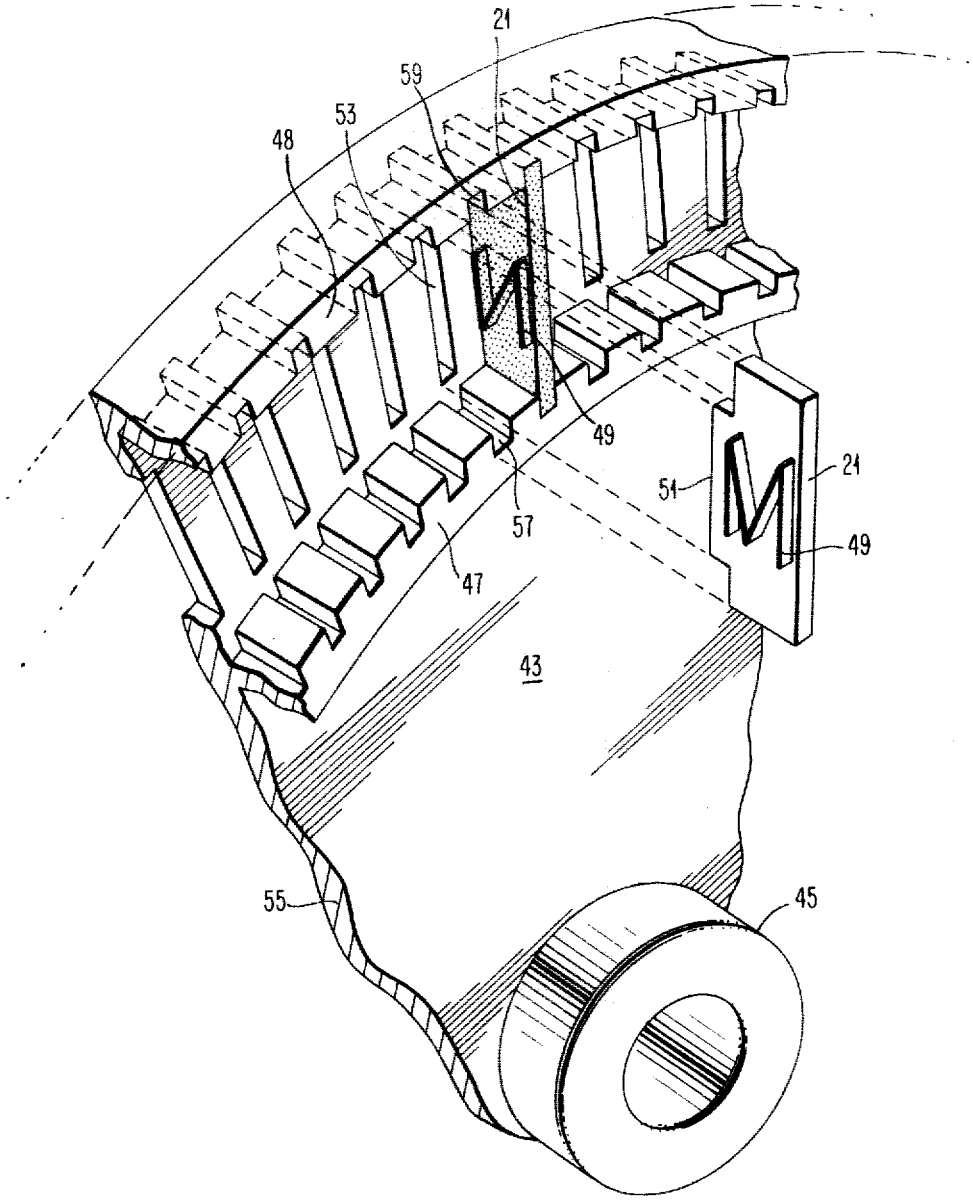
FIG. 2 is a perspective view of a portion of the carousel cartridge.

Referring now to FIG. 2 of the drawing a prospective view of a portion of the carousel cartridge 43 is depicted. The carousel cartridge 43 includes a central hub 45 which facilitates axial rotation of the carousel cartridge 43 for type chip 21 selection. The carousel cartridge 43 contains a plurality of type chips 21 mounted within the slotted guide members 47 and 48. Each type chip 21 contains a raised character image 49 for creating a print image on the document 15 of FIG. 1. Each type chip 21 is shaped to contain a central step 51 which locates within a corresponding slot 53 in the outer wall 55 of the carousel cartridge 43. It is this central step 51 which is engaged by a positioning mechanism (not shown) acting through the slot 53 in order to push the type chip 21 from the carousel cartridge 43, causing it to slide through the guides 57 and 59 of the slotted guide members 47 and 48 respectively.

Figure 3:
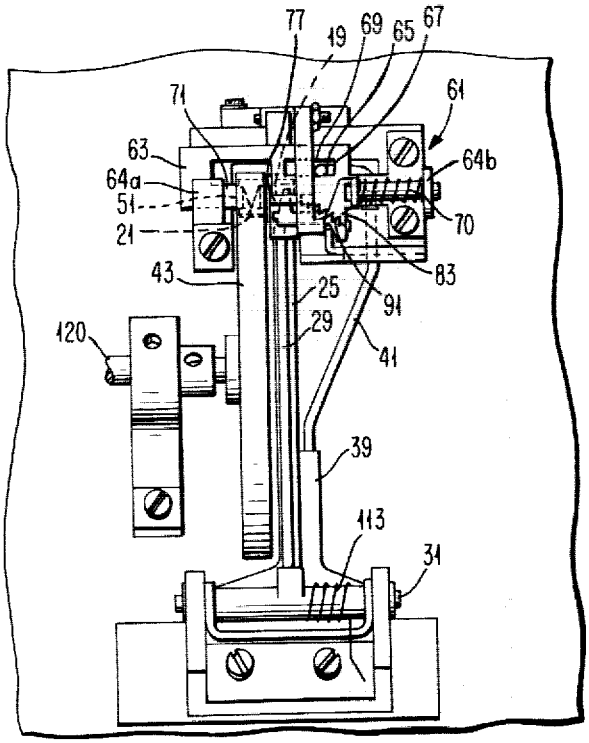
FIG. 3 is a frontal view of the print hammer in its type chip loading position and of the type chip positioning means as viewed along line III—III of FIG. 1.

Referring now to FIG. 3 of the drawing, a frontal view of the print hammer 19 in its type chip loading position and of the type chip positioning mechanism 61 is depicted.

The type chip positioning mechanism 61 includes a slide 63 which is driven from its rest position as depicted toward the right and through the guides 64*a* and 64*b* by action of the slide cam arm 41. As the slide cam arm 41 rotates about shaft 31, its end portion 65 engages surface 67 of the slide 63 causing it to move rightward as viewed due to the bend in the end portion 65. Thus, as the end portion 65 of the slide cam arm 41 moves upward as viewed in FIG. 1 through the aperture 69 formed in the slide 63, the slide 63 moves to the right compressing the spring 70. As the slide 63 moves rightward its end portion 71 engages the central step 51 of the type chip 21 through the slot 53 (FIG. 2) of the carousel cartridge 43. This causes the type chip 21 to move from the carousel cartridge 43 into slotted guides 73, 75 (FIG. 4) on the print hammer 19.

A restraining latch 77 is normally located within the guide 73, 75 (FIG. 4) of the print hammer 19 and is slideably mounted on the slide 63. Thus, as the type chip 21 moves rightward, it contacts the restraining latch 77 causing it to move rightward. The restraining latch 77 prevents the print hammer 19 from leaving its rest position until it clears the print hammer 19. This insures that the type chip 21 is fully located on the print hammer 19 prior to printing.

Figure 5:
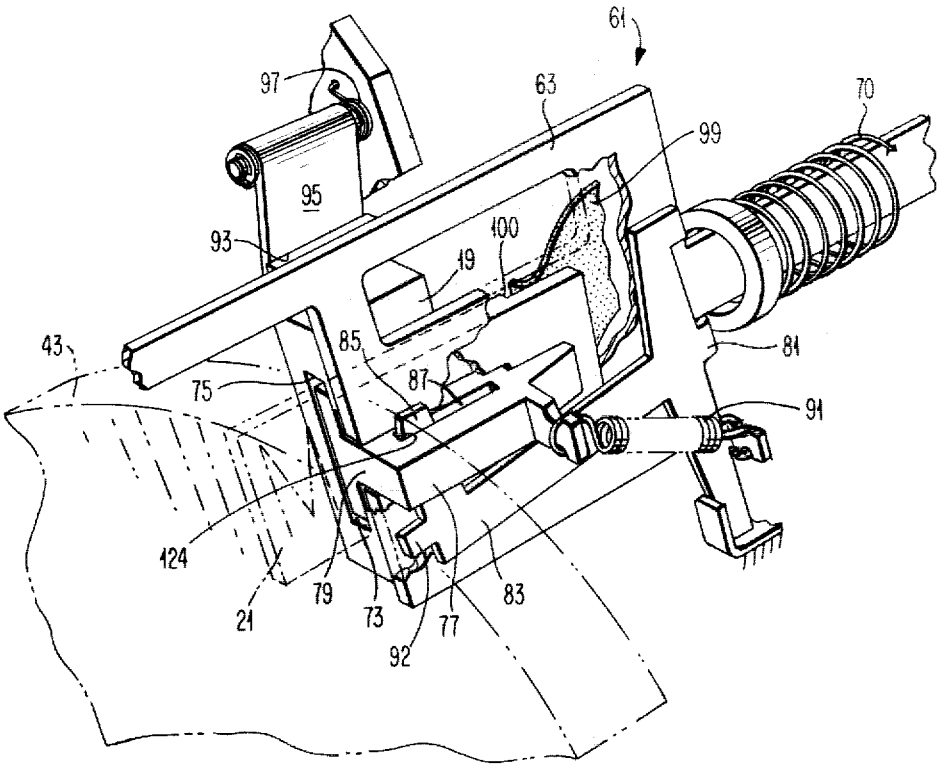
FIG. 5 is a perspective view of a portion of the type chip positioning means.

Referring now to FIG. 5 of the drawing, a perspective view of a portion of the type chip positioning mechanism 61 is depicted. As the type chip 21 is moved from the carousel cartridge 43, it contacts the end surface 79 of the restraining latch 77 causing it to also move rightward. As it moves rightward, it leaves the slots 73, 75 of the print hammer 19. Additionally, the slide 63 moves rightward compressing the spring 70 and ultimately clearing the print hammer 19 prior to clearance by the restraining latch 77.

During its initial motion, the slide 63 moves rightward relative to the restraining latch 77 and acts on a tab 81 of the latch keeper 83 causing it to rotate clockwise. As the latch keeper 83 rotates, its tab 85 moves upward within the slot 87 due to resilient urging of a spring 91 connected between the latch keeper 83 and the restraining latch 77. The tab 92 of the latch keeper 83 also then moves into the slot 87.

Movement of the slide 63 rightward causes the latch keeper 93 secured thereto to clear the interlock latch 95. When this occurs, the spring 97 urges the interlock latch 95 against the rear surface of the slide 63 thereby preventing the spring 70 from causing slide 63 to return leftward. It is noted that the interlock latch 95 thus occupies the space previously occupied by the print hammer 19 at this time since the print hammer is then no longer blocked by the restraining latch 77 and has left its type chip loading position as will be described.

Figure 6A:
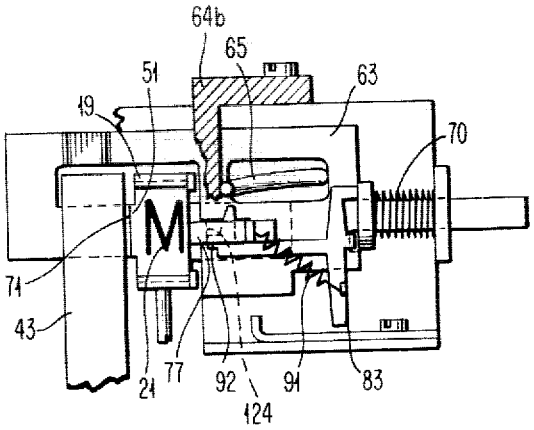
Figure 6B:
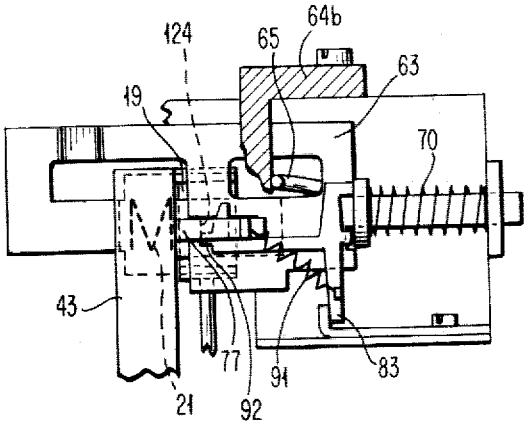
Figure 6C:
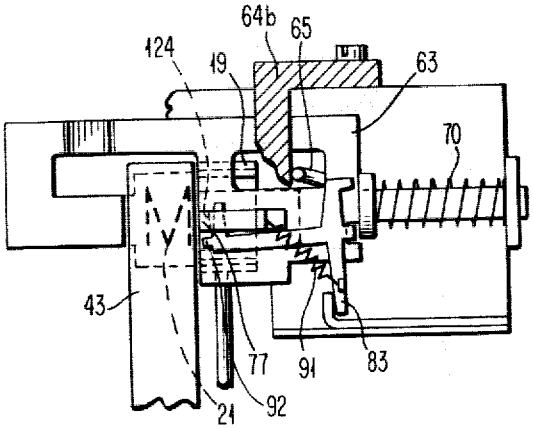

Upon return of the print hammer 19 to its type chip loading position, the interlock latch 95 is moved rearward against the urging of the spring 97 thereby clearing the latch keeper 93 and allowing the slide 63 to translate leftward under the urging of the spring 70. Return motion of the slide 63 is depicted in FIGS. 6*a*, 6*b* and 6*c*. As the slide 63 moves leftward from the position depicted in FIG. 6*a*, it causes the restraining latch 77 to move leftward therewith. The end surface 79 (FIG. 5) of the restraining latch 77 pushes the type chip 21 back into the carousel cartridge 43 as depicted in FIG. 6*b*. At this point, the latch keeper 83 is rotated counterclockwise so as to clear its tab 92 (FIG. 5) from the slot 87 of the restraining latch 77. The spring 91 then urges the restraining latch 77 rightward to the position in which it is depicted in FIG. 6*c* thereby allowing it to clear the carousel cartridge 43. In this manner, the carousel cartridge 43 may be thereafter rotated to effect the selection of an additional type chip 21. It is noted that the restraining latch 77 is constrained to move horizontally by a grounded leaf spring 99 of FIG. 5. The step 100 of the restraining latch 77 facilitates initial rightward relative motion of the restraining latch 77 and slide 63.

Referring now to FIG. 7 of the drawing, an exploded view of a portion of the type chip positioning mechanism 61 is depicted. This view depicts the interrelationship between the slide 63, the restraining latch 77, and the latch keeper 83.

Referring once again to FIG. 4 of the drawing, an exploded view of a portion of the print hammer 19 is depicted. This view depicts the interrelationship between the interlock latch 95 which rests against the surface 101 of the print hammer 19 when the print hammer is in its type chip loading position and the latch keeper 93 on the slide 63. A portion of the hammer guide latch 33 depicted in full in FIG. 1 is also depicted. The hammer guide latch 33 provides an absolute interlock to prevent return motion of the type chip positioning mechanism 61 under the urging of spring 70 (FIG. 3) during a printing stroke of the print hammer 19.

Referring now to FIG. 8 of the drawing, a rear view of a portion of the hammer guide latch 33 is depicted in the print hammer 19 type chip loading position. It is located between two guide blocks 103 and 105 contained on the base 107 with its end portion 109 resting against an adjustable stop 111.

Figure 9A:
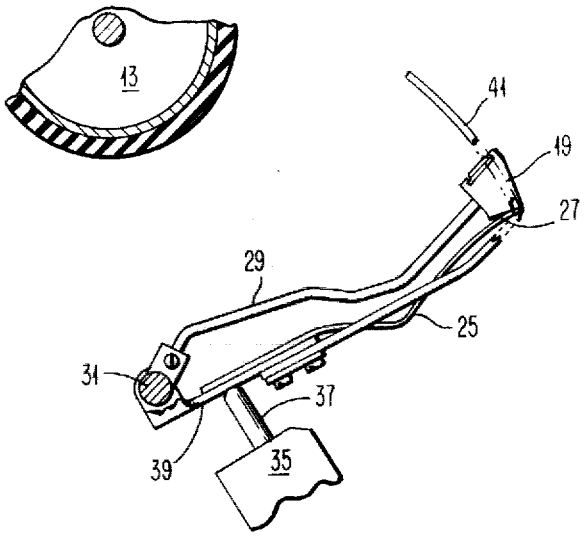
Figure 9B:
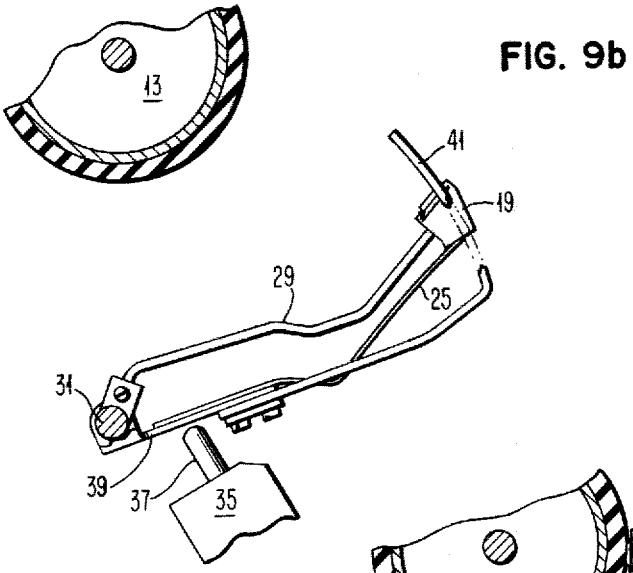
Figure 9C:
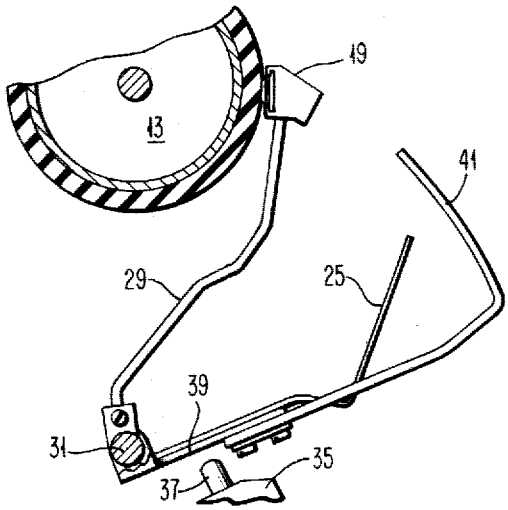

Referring now to FIGS. 9*a*, 9*b*, and 9*c*, schematic motion diagrams of the print hammer 19 are depicted. FIG. 9*a* depicts the relative positions of the print hammer 19, slide cam arm 41, output driver 39, energy storage spring 25, and solenoid motor 35 following solenoid motor 35 energization and just prior to release of the print hammer 19 by the restraining latch 77 of FIG. 3. In this position, the slide cam arm 41 has been raised from the position depicted in FIG. 1 effecting the translation motion of the type chip positioning mechanism 61 of FIG. 3. Further, the drive arm 39 has been rotated in a counterclockwise direction about the shaft 31 causing the energy storage spring 25 secured thereto to be compressed against the back surface 27 of the print hammer 19. The arm 29 and print hammer 19 have not yet rotated about the shaft 31 due to the holding motion of the restraining latch 77 of FIG. 3.

FIG. 9*b* depicts the print hammer 19 during its flight toward the platen 13 at a point in time immediately following de-energization of the solenoid motor 35. Up until this point, the energy storage spring 25 powers the hammer 19 toward the platen. Upon de-energization of the solenoid motor 35, its armature 37 is withdrawn from the output driver 39 thus eliminating the ground path of the energy storage spring 25. At this point, the energy storage spring 25 no longer imparts momentum to the print hammer 19 which thereafter travels in free flight to impact the platen 13 as depicted in FIG. 8*c*.

The rebound energy from the striking of the print hammer 19 against the platen 13, gravity, and the bias of spring 113 of FIG. 3 causes the print hammer 19 to return to its initial position. In doing so, it engages the energy storage spring 25 which now freely rotates along with the output driver 39 in a clockwise direction about the shaft 31 to its rest position. Additionally, return movement of the print hammer 19 resets the interlock latch 95 of FIG. 5 allowing the slide 63 of FIG. 3 to return leftward under the urging of spring 70 of FIG. 3.

In order to more fully understand the functional aspects of the invention, a basic machine cycle of the preferred embodiment of the invention will now be described.

In a typical printing operation, the operator of a printing apparatus depresses a character key on a keyboard (not shown) which results, as is well known, in an electrical selection signal being sent to a motor drive or the like (not shown) and in a printing actuation signal being generated. In selecting the appropriate character for printing, the motor drive, which may be in the form of a stepper motor, is rotated a number of steps effecting corresponding rotation of the shaft 120 which is coupled to the hub 45 of the carousel cartridge 43. The shaft rotation is continued until the selected type chip 21 is presented at the loading position as shown in FIGS. 3 and 5. The motor drive, logic and circuitry employed to effect carousel cartridge 43 positioning may be identical to that presently used in daisy wheel printers to position a print spoke. Upon completion of the character selection process, a printing actuation signal is sent to the solenoid motor 35. This signal may be in the form of a single pulse, the duration of which controls the selected printing force which is applied to the print hammer 19 for printing. The logic employed to generate varying length pulses dependent upon character area size and desired print density may also be identical to the logic utilized in daisy wheel printers to control the print hammer actuation signal thereof for the same purpose.

Figure 4:
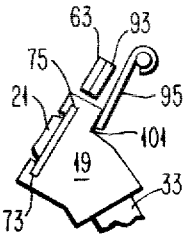
FIG. 4 is a side view of a portion of the print hammer and interlock latch.

With reference to FIGS. 1 and 3, energization of the solenoid motor 35 by the print actuation signal causes the armature 37 to engage the output driver 39 rotating it counterclockwise as viewed in FIG. 1 about the shaft 31 in the frame 122 toward the platen 13. As it does so, it compresses the attached energy storage spring 25 against the back surface 27 of the print hammer 19 and at the same time rotates the rigidly attached slide cam arm 41. The angularly extending end portion 65 of the slide cam arm 41 in turn pushes on the surface 67 of the slide 63 as the slide cam arm 41 rotates in response to the solenoid motor 35 activation. With increasing rotation of the slide cam arm 41, its end portion 65 increasingly protrudes through the aperture 69 of the slide 63 exerting a sideward camming or wedging force on the surface 67 causing the slide 63 to move to the right as illustrated in FIG. 3. The end portion 71 of the slide 63 in turn contacts and begins to push the central step 51 of the type chip 21 causing the type chip to be pushed out of the carousel cartridge 43 and into the slotted guides 73 and 75 in the face of print hammer 19 (FIG. 4).

Spring 99 and inertia forces acting on the restraining latch 77 cause it to tend to remain stationary in the guides 73 and 75 until it is contacted by the type chip 21 as the latter is pushed by the slide 63. The type chip 21 thus pushes the restraining latch 77 rightward. The relative motion of the slide 63 and the restraining latch 77 results in the latch keeper 83 being able to rotate clockwise (FIG. 5) until it contacts and latches as shown in FIG. 6*a* with tab 92 engaging surface 124 of the restraining latch 77. The rotational torque on the latch keeper 83 is a result of the small spring 91 connected between the latch keeper 83 and the restraining latch 77.

As the slide 63 moves to the end of its travel under the urging of the slide cam arm 41, the restraining latch 77 slides from the slotted guides 73 and 75 of the print hammer 19. This releases the print hammer 19 to move under the urging of the energy storage spring 25 just as the type chip 21 slides completely into position on the face of the print hammer 19. The result is that the arm 29 and print hammer 19 being no longer restrained, rotate into accelerating activation about the shaft 31 under the compression force of fully loaded energy storage spring 25 reacting against the reaction of the still activated armature 37 of the solenoid motor 35. Sufficient momentum is imparted to the print hammer 19 by the energy storage spring 25 to cause printing when the type chip 21 located thereon impacts the print ribbon 23 onto the document 15 located on the platen 13.

Duration of energization of the solenoid motor 35 corresponds to the pulse length of the print actuation signal supplied thereto. Increased pulse length results in an increased solenoid motor 35 activation duration. The initial portion of the signal pulse results in the solenoid motor 35 loading of the energy storage spring 25 and type chip 21 transference as has been described. The remaining portion of the signal pulse, the duration of which depends on the overall pulse length, determines the amount of energy or momentum transferred to the arm 29 and print hammer 19. The solenoid motor 35 is de-engerized as the signal ends once sufficient impact momentum has been transferred to the print hammer 19. When this occurs, no further energy from the energy storage spring 25 can be obtained, as the solenoid motor 35 produces the reaction force through its armature 37 that permits the stored energy in the energy storage spring 25 to be transferred to the print hammer 19.

Once the print hammer starts its printing stroke, it releases the interlock latch 95 resting thereagainst which rotates in a clockwise direction as viewed in FIG. 4. The slide 63 is then restrained from restoring under the urging of the spring 70 by the action of the interlock latch 95 acting against the latch keeper 93 on the slide 63. To further insure that the slide 63 will not restore when the print hammer 19 is in motion, the hammer guide latch 33 attached to the print hammer 19 serves as an absolute interlock to prevent such restoration when the print hammer 19 is in motion away from its type chip loading position. The hammer guide latch 33 further serves as a guide to insure that the print hammer 19 is spaced slightly away from the carousel cartridge 43 upon its return at the end of the print cycle so that the carousel cartridge 43 is free to rotate. This is partially accomplished by cooperation of the hammer guide latch 33 with the alignment guides 103 and 105 of FIG. 8. The rest position of the print hammer 19 is determined by the vertical location of the stop 111.

The print hammer 19 and arm 29 rebound following impact with the platen 13 toward the type chip loading position. Spring 113 further powers the arm 29 in this direction. In restoring, the print hammer 19 engages the now freely rotatable energy storage spring 25 causing it to rotate clockwise and carry therewith the output driver 39 and slide cam arm 41. When the print hammer 19 approaches the last millimeter or so of its travel, it knocks the interlock latch 95 off thus allowing the slide 63 and restraining latch 77 to be urged against the side of the print hammer 19. As the print hammer 19 comes to its type chip loading position, the restraining latch 77, clears the side of the print hammer 19 and begins to push the type chip 21 back into the carousel cartridge 43 thus reloading it. The pushing motion on the slide 63 is generated by the energy previously stored in the spring 70.

Once the restraining latch 77 starts to pass in front of the print hammer 19 and through the slotted guides 73 and 75, the print hammer 19 becomes latched in its rest position thereby preventing any rebound of the print hammer 19 that might possibly lead to potential malfunction. The restraining latch 77 continues to push on the type chip 21 until it is completely restored back into its proper location in the carousel cartridge 43. When this occurs, the latch keeper 83 is caused to rotate counterclockwise thereby releasing the restraining latch 77, allowing the spring 91 to pull the restraining latch 77 back away from the carousel cartridge 43. Clearance is thereby created freeing the carousel cartridge 43 for subsequent rotation for further type chip selection. This action completes one print cycle.

Once printing has been effected, the platen 13 is moved relative to the print mechanism 17 in a conventional fashion so that the next subsequent character may be printed in a position adjacent the character just printed. Additionally, the print ribbon 23 is advanced in a conventional fashion to create a fresh imaging area thereon. As is apparent to those skilled in the art, the print mechanism 17 could also be mounted on a movable carrier to effect relative motion between itself and the platen 13. Further, the print mechanism 17 could form a portion of a keyboardless printer. Additionally, the carousel cartridge 43 may be removably mounted to the shaft 120 so that different character fonts can be interchangeably utilized with the print mechanism 17.

As may be further readily perceived by those skilled in the art in reading the above specification, numerous other modifications and variations of the above mentioned invention may be made without departing from the spirit and scope of the invention described herein.

What is claimed is:

1. In an impact printer having a platen, a print hammer, and a cartridge provided with a plurality of type chips, the improvement comprising:

a drive motor;

energy storage means for storing print hammer driving energy derived from motion of said motor;

type chip positioning means responsive to said motion of said motor to transfer a selected type chip to a preprinting loaded position on said print hammer from said cartridge;

means responsive to the positioning of a selected type chip on said print hammer to release said energy storage means for accelerating said print hammer towards said platen whereby said type chip impacts said platen.

2. The impact print of claim 1 wherein the drive motor comprises a solenoid which is in driving cooperation with the energy storage means and the type chip positioning means.

3. The impact printer of claim 1 wherein the energy storage means comprises resilient means adapted to be loaded by said drive motor.

4. The impact printer of claim 2 or 3 wherein said drive motor provides reaction force to the energy storage means to maintain the load thereon while said drive motor is activated and to release said reaction force when said drive motor is de-activated.

5. The impact printer of claim 4 wherein said drive motor is pulse activated and wherein the activation period of the motor is proportional to pulse duration.

6. The impact printer of claim 5 wherein said drive motor is activated by a pulse of sufficient duration to load the energy storage means and to maintain a reaction force against the energy storage means for sufficient time following said release thereof to permit predetermined acceleration of the print hammer towards said platen.

7. The impact printer of claim 6 wherein the accelerating energy imparted to the print hammer varies in proportion to the activation period of said drive motor to thus impart a selectable varying impact force to said print hammer.

8. The impact printer of claim 1 wherein said type chip positioning means further includes restraining latching means for restraining said print hammer in its type chip loading position until said chip transfer is completed.

9. The impact printer of claim 8 wherein said restraining latching means is adapted to be contacted by a chip being transferred to said print hammer to effect release of said print hammer when said chip is fully transferred to said print hammer.

10. The impact printer of claim 9 wherein said restraining latching means includes a latch member which is contacted by said chip, said latch member further pushing said chip back into said cartridge upon return of said print hammer to its type chip loading position and latching said hammer in its type chip loading position.

11. The impact printer of claim 10 wherein said latching member is resiliently urged to push said chip back into said cartridge.

12. The impact printer of claim 11 further including latch restore means for restoring said latch member from said cartridge upon insertion of said chip into said cartridge.

13. The impact printer of claim 9 further including interlock latching means in cooperative communication with said type chip positioning means to restrain movement of said type chip positioning means when said print hammer is displaced from its type chip loading position toward said platen.

14. The impact printer of claim 13 wherein said print hammer includes latching reset means for releasing said interlock latching means upon print hammer return to the type chip loading position after printing.

15. The impact printer of claim 1 wherein said type chip positioning means includes a cam arm in driven cooperation with said drive motor and a type chip transfer slide in camming cooperation with said cam arm for transferring said type chip from said cartridge to said print hammer.

16. The impact printer of claim 15 wherein type chip transfer is effected while driving force is being accumulated in said energy storage means.

* * * * *